US006672852B1

(12) United States Patent
Chang et al.

(10) Patent No.: US 6,672,852 B1
(45) Date of Patent: Jan. 6, 2004

(54) LUBRICANT FILLING DEVICE FOR SCROLL COMPRESSOR

(75) Inventors: Lung-Tsai Chang, Taoyuan Hsien (TW); Guang-Der Tarng, Taoyuan Hsien (TW); Chung-Pen Chiu, Taoyuan Hsien (TW)

(73) Assignee: Rechi Precision Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/418,200

(22) Filed: Apr. 18, 2003

(51) Int. Cl.[7] ..... F01C 1/02

(52) U.S. Cl. ..... 418/55.6; 418/94; 418/99; 184/6.18

(58) Field of Search ..... 418/55.6, 94, 99; 184/6.18

(56) References Cited

U.S. PATENT DOCUMENTS 4,502,852 A * 3/1985 Hazaki ..... 418/55.6
5,137,437 A * 8/1992 Machida et al. ..... 418/55.1
5,249,941 A * 10/1993 Shibamoto ..... 418/55.6

FOREIGN PATENT DOCUMENTS

JP 58126491 A * 7/1983 ..... F04C/18/02
JP 04203377 A * 7/1992 ..... F04C/18/02

* cited by examiner

*Primary Examiner*—Thomas Denion
*Assistant Examiner*—Theresa Trieu
(74) *Attorney, Agent, or Firm*—Troxell Law Office PLLC

(57) ABSTRACT

A lubricant filling device for a scroll compressor has provided a lubricant suction on the circulating scroll connecting through the side of the sleeve to the scroll space; a negative pressure suction being formed due to changed volume in the scroll chamber once the circulating scroll and the fixed scroll chamber are operating, so to directly suck the lubricant seeping through where between the eccentric rod and the sleeve to lubricate the circulating scroll and the fixed scroll chamber in time for improving the lubrication results for the compressor.

2 Claims, 4 Drawing Sheets

LUBRICANT FILLING DEVICE FOR SCROLL COMPRESSOR

BACKGROUND OF THE INVENTION

1. Field of the Invention

The present invention is related to a lubricant filling device, and more particularly, to one that allows the lubricant to be sucked into the scroll chamber of the circulating scroll once the circulating scroll and the fixed scroll chamber of the compressor are operating so to fill the lubricant the circulating scroll s and the fixed scroll chamber in time.

2. Description of the Prior Art

The working principle of a general compressor essentially involves the heat change resulted from the heat absorption and release cycle between the gaseous phase and the liquid phase of the coolant achieved by changing the volume of the coolant. As illustrated in FIG. 1 of the accompanying drawings for a schematic view of the structure of a scroll compressor of the prior at, the interior of the compressor is essentially divided into a low-pressure chamber (A1) and a high-pressure chamber (A2) by means of a separation base (B). A coolant inlet (A11) and a coolant outlet (A21) are respectively provided by the side of the LP chamber and the HP chamber (A2). A fixed scroll chamber (C1) and a circulating scroll (C2) are provided below the separation base (B) on the side of the LP chamber (A1) for the circulating scroll (C2) driven by an eccentric rod (C3) to engage in revolution inside the fixed scroll chamber (C1) without revolving on the axis of the circulating scroll (C2), thus to change the volume of the space between the fixed scroll chamber (C1) and the circulating scroll (C2) while engaging in suction and compression of the coolant entering into the LP chamber (A1) to change the volume of the coolant. The compressed HP coolant flows out of a drainage (C11) into a connection hole (B1) of the separation base (B) and is stored in the HP chamber (A2) before being released through the coolant outlet (21) to leave the compressor (A) for performing the heat exchange in cycle between a coolant pipe and the compressor.

Whereas high-speed operation takes place between the circulating scroll (C2) and the fixed scroll chamber (C1), sufficient lubrication is required between circulating scroll (C2) and the fixed scroll chamber (C1) for maintaining a smooth operation of the compressor. In the prior art of the scroll compressor, a pump (D) is provided at the bottom of an accommodation part to feed the lubricant through lubricant filling passage (C31) at the center of a eccentric rod (C3) into the area between the circulating scroll (C2) and a sleeve (C21) that is connected to the eccentric rod (C3) to lubricate where between the eccentric rod. (C3) and the sleeve (C21) of the circulating scroll (C2).

Furthermore, the lubricant between the eccentric rod (C3) and the sleeve (C21) flows back to the bottom of the accommodation part for recycled use. When the compressor is operating, the lubricant seeping through where between the eccentric rod (C3) and the sleeve (C21) flows in the same direction of the coolant under pressure to the circulating scroll (C2), through the coolant inlet (A11) and attaches to the blade of the circulating scroll so to lubricate where between the circulating scroll (C2) and the fixed scroll chamber (C1) while the circulating scroll (C2) revolves around the fixed scroll chamber (C1).

However, the lubricant is admitted into where between the circulating scroll (C2) and the fixed scroll chamber (C1) only it is led by the coolant and spreads up to cover the contact area between the circulating scroll (C2) and the fixed scroll chamber (C1) only after a longer time of operation in relation to the fixed scroll chamber (C1). Consequently, the lubricant is prevented from easily entering into where between the circulating scroll (C2) and the fixed scroll chamber (C1) in case of insufficient amount of coolant or insufficient pressure when the compressor is just started while both of the circulating scroll (C2) and the fixed scroll chamber maintain operation at high speed, resulting in insufficient lubrication and accelerated tear and wear of the contact surface between the circulating scroll (C2) and the fixed scroll chamber (C1).

SUMMARY OF THE INVENTION

The primary purpose of the present invention is to provide a lubricant filling device for a scroll compressor to improve the lubrication results for the compressor. To achieve the purpose, a lubricant suction oil is provided on the circulating scroll of the compressor by the side of the sleeve connecting through the scroll space; so that once the circulating scroll and the fixed scroll chamber operate, a suction of negative pressure is created due to changed volume in the scroll space for the lubricant seeping through where between the eccentric rod and the sleeve to be directly sucked through the lubricant suction into the scroll space of the circulating scroll to lubricate the circulating scroll and the fixed scroll chamber to improve the lubrication results for the compressor.

Another purpose of the present invention is to provide a lubricant filling device for a scroll compressor that the lubricant is directly sucked into the scroll space of the circulating scroll by the negative pressure created from changed volume in the scroll space without being subject to the amount of the coolant.

Another purpose yet of the present invention is to provide a lubricant filling device for a scroll compressor that the direction of the lubricant being sucked into the circulating scroll is controlled by defining an inclination to the lubricant suction.

DETAILED DESCRIPTION OF THE PREFERRED EMBODIMENTS

Figure 1:
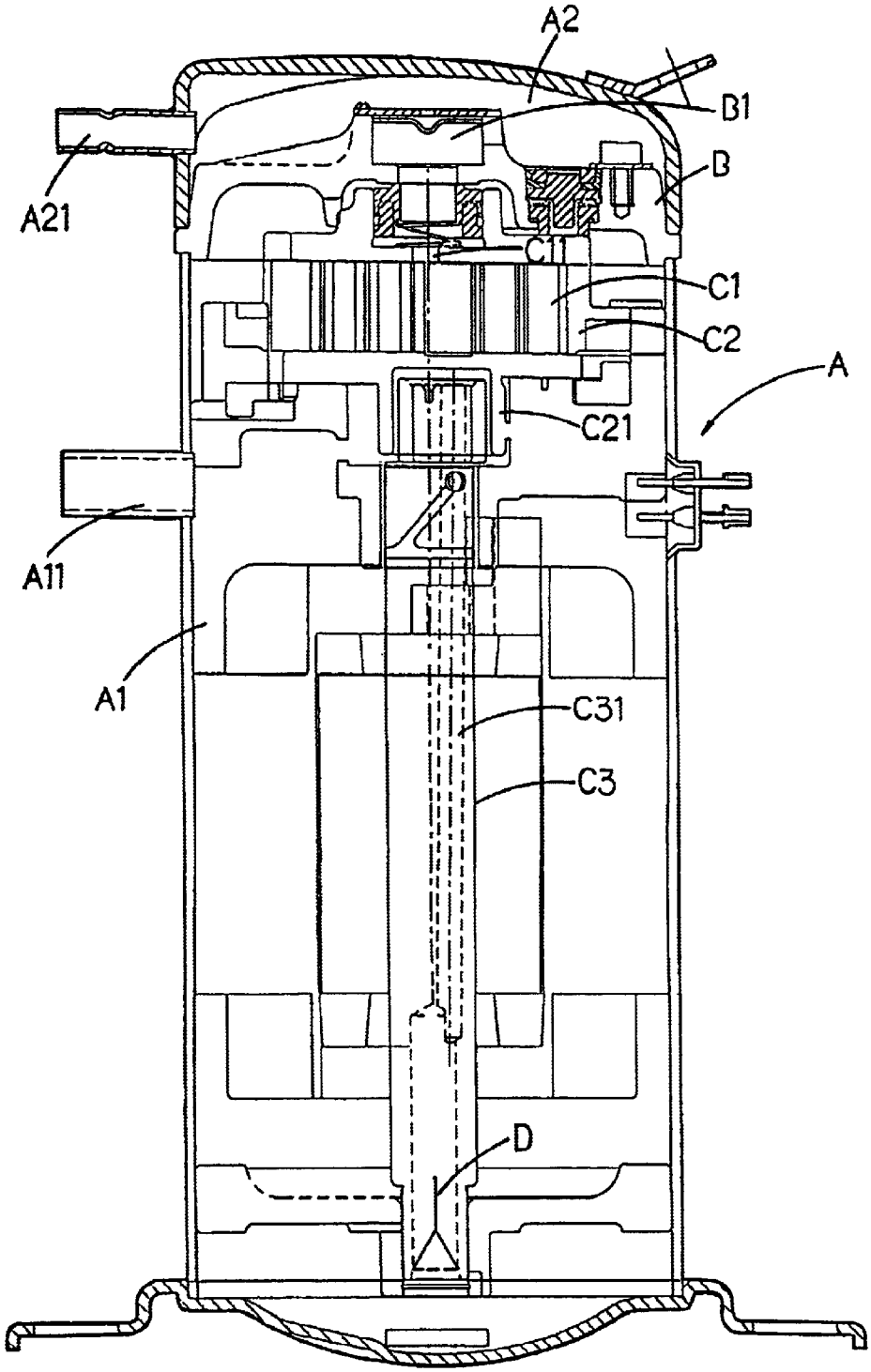
FIG.1 Prior Art
FIG. 1 is a schematic view showing the structure of a scroll compressor of the prior art.
Figure 2:
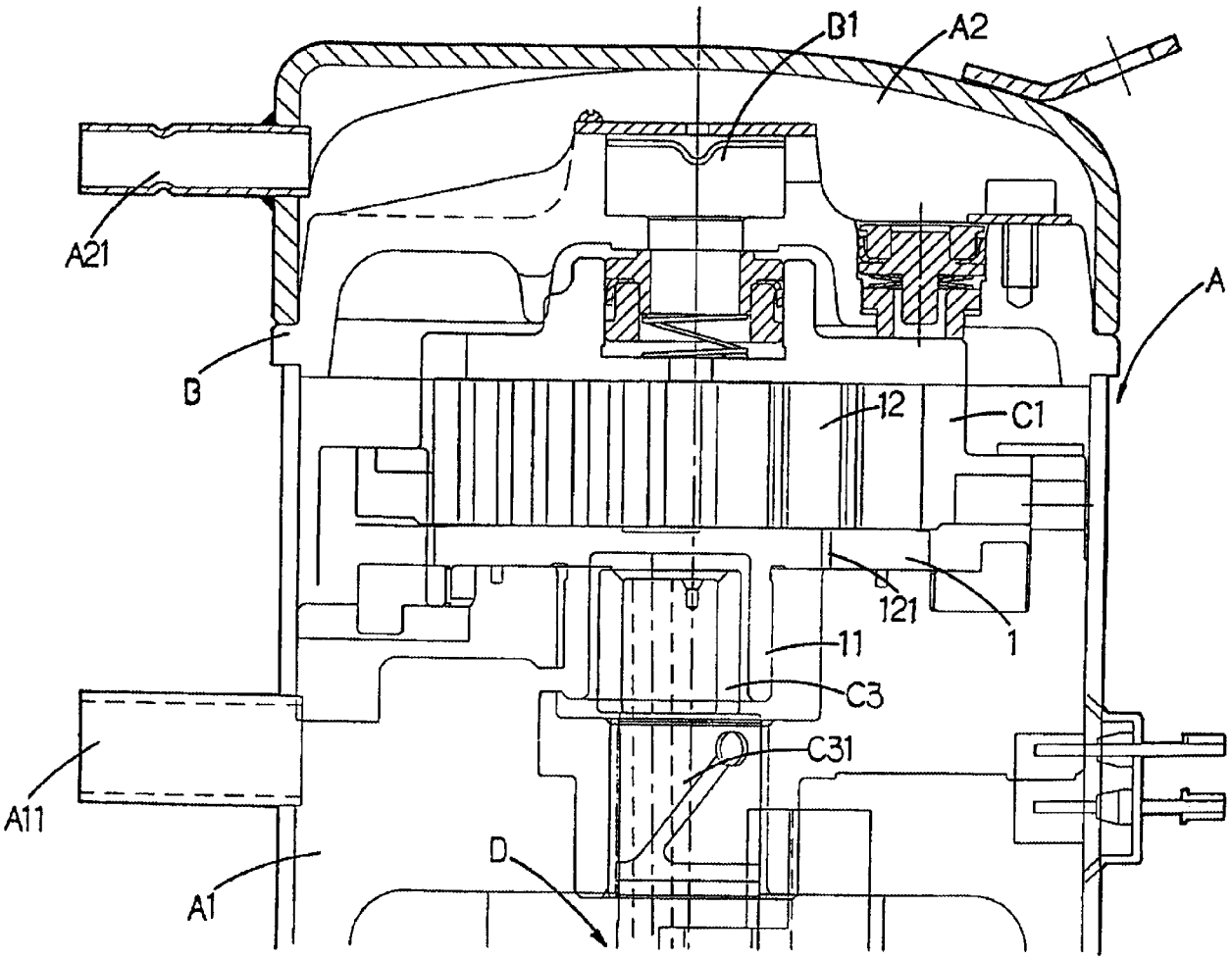
FIG. 2 is a sectional view showing the structure of a preferred embodiment of the present invention.

Referring to FIG. 2, a preferred embodiment of the present invention is essentially applied for lubricating where between a circulating scroll and a fixed scroll chamber of a scroll compressor. Wherein, the closed space in the compressor is divided with a separation base (B) into a low-pressure chamber (A1) and a high-pressure chamber (A2); and a coolant inlet (A11) and a coolant outlet (A21) are respectively provided on the side of the LP chamber (A1) and on the side of the HP chamber (A2) . Meanwhile, on the side of the LP chamber (A1) a fixed scroll chamber (C1) and a circulating scroll (1) are provided at where below the separation base (B) for the circulating scroll (1) to revolve inside the fixed scroll chamber (C1) as driven by an eccentric rod (C3) to change the volume of the space between the fixed scroll chamber (C1) and the circulating scroll (1) thus to further change the volume of the coolant for the coolant to execute heat exchange by changing between gaseous phase and liquid phase for heat absorption and release in cycle.

Figure 3:
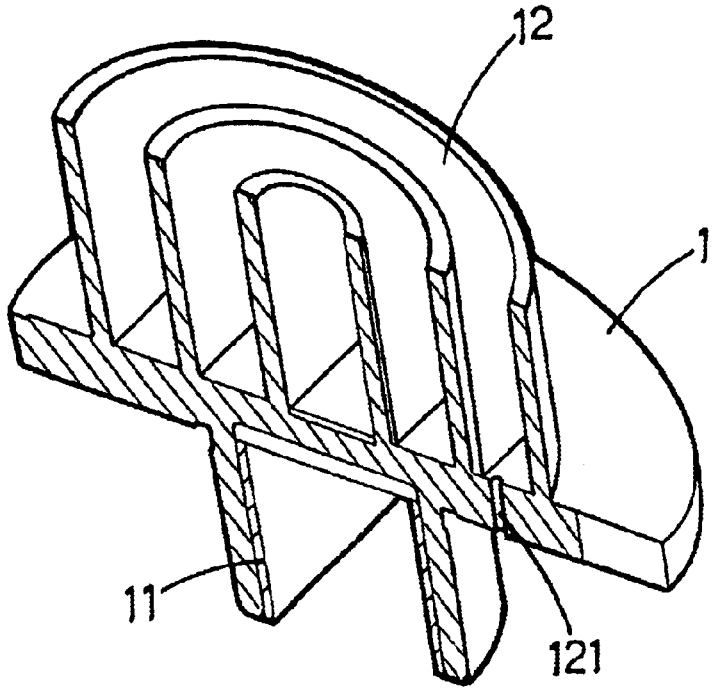
FIG. 3 is a view showing the appearance of the structure of a circulating scroll of the preferred embodiment in operation.
Figure 4:
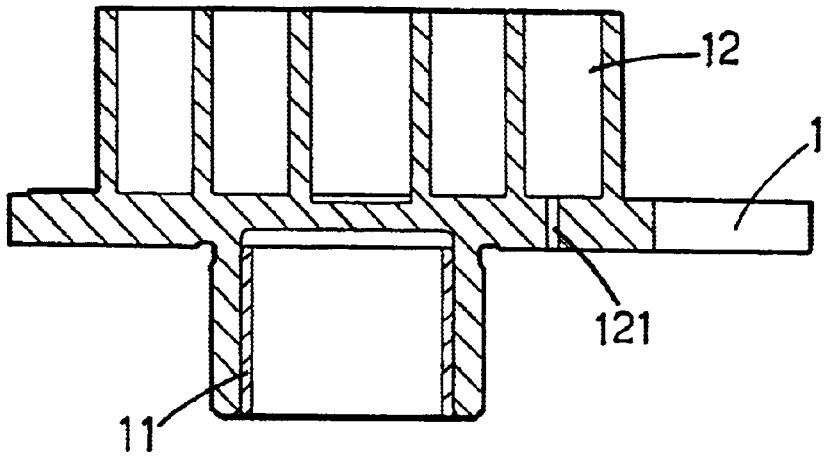
FIG. 4 is a sectional view of the structure of the circulating scroll of the preferred embodiment in operation.

A pump (D) is provide at the bottom of the lubricant filling device to deliver the lubricant through a central passage (C31) in the eccentric rod (C3) into and to lubricate the area between the circulating scroll (1) and a sleeve (11) connected to the eccentric rod (1). Also referring to FIGS. 3 and 4, a suction hole (121) connecting through the side of the sleeve (11) into the scroll space (12) is provided on the circulating scroll (1). As illustrated in FIG. 2, once the circulating scroll (1) and the fixed scroll chamber (C1) operate, a suction by negative pressure is created from changed volume in the scroll space (12) the lubricant seeping through where between the eccentric rod (C3) and the sleeve (11) is directly sucked in through the suction hole (121) to lubricate the area between the circulating scroll (1) and the fixed scroll chamber (C1); and the flowing direction of the lubricant sucked in is controlled by defining an inclination to the suction hole (121).

Whereas the lubricant is sucked into the scroll space (12) of the circulating scroll (1) by the negative pressure created from changed volume of the scroll space (12) as the circulating scroll (1) and the fixed scroll chamber (C1) are operating, the lubricant is delivered to the contact area between the circulating scroll (1) and the fixed scroll chamber (C1) to significantly improve the lubrication results therein. Furthermore, the supply of the lubricant is not subject to the amount of the coolant. Under the normal operation of the compressor, the lubricant seeping through where between the eccentric rod (C3) and the sleeve (11) is also brought into the circulating scroll (1) from the coolant inlet under pressure in the flowing direction of the coolant; and the excessive lubricant flows back simultaneously into the bottom of the compressor for recycled use.

The improved lubricant filling structure for a scroll compressor of the present invention by having provided the lubricant suction hole that connects the side of the sleeve through the a scroll space to create suction by negative pressure from changed volume of the scroll space to directly suck the lubricant seeping through where between the eccentric rod and the sleeve into and to lubricate the area between the circulating scroll and the fixed scroll chamber as the circulating scroll and the fixed scroll chamber operate to significantly improve the lubrication results for the compressor, provides a better lubricant filling device for the scroll compressor. This application for utility is duly filed accordingly.

We claim:

1. A lubricant filling device for a scroll compressor; wherein, the compressor being divided into a low-pressure chamber and a high-pressure chamber by means of a separation base, a coolant inlet and a coolant outlet being respectively provided on one side of the low-pressure chamber and on one side of the high pressure chamber; a fixed scroll chamber and a circulating scroll being provided on the low-pressure chamber side under the separation base to change the volume between the fixed scroll chamber and the circulating scroll; heat exchange results being achieved by heat suction and release executed by changing the volume of the coolant between its gaseous and liquid phases; and a pump being provided to a lubricant filling device at the bottom of the compressor to deliver the lubricant through the central lubricating passage in an eccentric rod into where between the circulating scroll and the sleeve connected to the eccentric rod to lubricate therein, characterized by that: a lubricant suction hole that connects the side of the sleeve through the a scroll space being provided to create suction by negative pressure from changed volume of the scroll space to directly suck the lubricant seeping through where between the eccentric rod and the sleeve into and to lubricate the area between the circulating scroll and the fixed scroll chamber as the circulating scroll and the fixed scroll chamber operate.

2. A lubricant filling device for a scroll compressor as claimed in claim 1, wherein, the lubricant suction hole is defined with a certain inclination for the control of the direction of the lubricant sucked into the circulating scroll.

* * * * *